US007896475B2

(12) United States Patent
Omata et al.

(10) Patent No.: US 7,896,475 B2
(45) Date of Patent: Mar. 1, 2011

(54) ELEMENT SUBSTRATE, PRINTHEAD, AND HEAD CARTRIDGE

(75) Inventors: Koichi Omata, Kawasaki (JP); Yoshiyuki Imanaka, Kawasaki (JP); Takaaki Yamaguchi, Yokohama (JP); Kousuke Kubo, Yokohama (JP); Souta Takeuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 150 days.

(21) Appl. No.: 12/249,484

(22) Filed: Oct. 10, 2008

(65) Prior Publication Data

US 2009/0109261 A1 Apr. 30, 2009

(30) Foreign Application Priority Data

Oct. 24, 2007 (JP) ..... 2007-276756

(51) Int. Cl.
*B41J 2/05* (2006.01)

(52) U.S. Cl. ..... 347/59

(58) Field of Classification Search ..... 347/59, 347/50, 54, 56, 57–58, 61–65, 44, 40, 20
See application file for complete search history.

(56) References Cited

U.S. PATENT DOCUMENTS 6,137,502 A 10/2000 Anderson et al.
6,824,237 B2 11/2004 Hirayama et al.
7,216,960 B2 5/2007 Imanaka et al.
7,309,120 B2 12/2007 Hatsui et al.
7,364,284 B2 4/2008 Hatsui et al.
7,581,821 B2 * 9/2009 Hatsui et al. ..... 347/59
7,588,317 B2 * 9/2009 Imanaka et al. ..... 347/48
2005/0285904 A1 12/2005 Toge et al.
2008/0129781 A1 * 6/2008 Furukawa ..... 347/50

FOREIGN PATENT DOCUMENTS

JP 2007-144711 6/2007
WO 2007/061138 5/2007

* cited by examiner

*Primary Examiner*—K. Feggins
(74) *Attorney, Agent, or Firm*—Fitzpatrick, Cella, Harper & Scinto

(57) ABSTRACT

A small-size element substrate with high electrical efficiency can be achieved when a plurality of printing element arrays having the same discharge amount exist on a single element substrate, and transistors which form driver arrays corresponding to the respective printing element arrays are formed at different array densities including transistors which form a driver array corresponding to a printing element array having a different discharge amount. The area of each transistor of the first driver array corresponding to the first printing element array is set larger than that of each transistor of the second driver array corresponding to the second printing element array. The wiring width of the first power supply wiring pattern corresponding to the first printing element array in a direction perpendicular to the printing element array is set smaller than that of the second power supply wiring pattern corresponding to the second printing element array.

7 Claims, 15 Drawing Sheets

ELEMENT SUBSTRATE, PRINTHEAD, AND HEAD CARTRIDGE

BACKGROUND OF THE INVENTION

1. Field of the Invention

The present invention relates to an element substrate for an inkjet printhead, a printhead using the element substrate, and a head cartridge having the printhead.

2. Description of the Related Art

The electrothermal transducers (heaters) of a printhead mounted in an inkjet printing apparatus, and their driving circuit and wiring pattern are generally formed on a single substrate using a semiconductor process technique. A known example of the printhead having this arrangement is one disclosed in U.S. Pat. No. 7,216,960.

FIGS. 18 and 19 are schematic views showing an example of a conventional element substrate for an inkjet printhead.

FIGS. 18 and 19 characteristically show the same part of the element substrate. FIG. 18 mainly shows a heater driving power supply wiring pattern and ground wiring pattern. FIG. 19 mainly shows a heater driver, logic wiring pattern, and logic circuit below these wiring patterns.

The arrangement of respective components will be explained first with reference to FIG. 19. An ink supply port 604 is formed at the center of the element substrate, and heater arrays 807 are arranged on the two sides of the ink supply port 604. Ink channels, and orifices for discharging ink are formed in the element substrate in correspondence with respective heaters, and ink is supplied to them via the ink supply port 604. A driver array 901 is arranged on the outer side of each heater array 807. A logic circuit wiring pattern and logic circuit 106 are arranged on the outer side of each driver array 901. Connection terminals 905 are arranged near each short side of the element substrate. A shift register (S/R) 903, a decoder 904, a temperature sensor (not shown), and the like are interposed between the connection terminals 905 and the ink supply port 604.

In FIG. 18, a heater driving power supply wiring pattern 803 is arranged above each driver array 901. A ground wiring pattern 804 is arranged above each logic circuit 106. These wiring patterns are connected to the outside via heater driving connection terminals 801 and ground connection terminals 802, respectively.

Heaters in the heater array are driven by a so-called time division driving method of shifting the driving timing for each block of simultaneously drivable heaters.

In order to make the wiring resistances of arrayed heaters almost equal to each other, the power supply wiring pattern is divided for each driving group of heaters not driven simultaneously. The respective wiring patterns have different widths in accordance with the distance from the connection terminal, so as to make resistance values almost equal to each other. For example, a wiring pattern having a longer distance and larger wiring length has a larger width. In each driving group, the number of simultaneously driven heaters is one, so the voltage drop by the wiring resistance is almost equal between heaters.

In FIG. 19, the connection terminals 905 are arranged near the two short sides of the element substrate. This is because the wiring width becomes excessively large if the connection terminals 905 are arranged on only one short side of the element substrate and the wiring pattern extends up to the other short side. As shown in FIG. 18, the power supply wiring patterns are symmetrical in the longitudinal direction on the sheet surface of FIG. 18. That is, the heater driving connection terminals 801 and ground connection terminals 802 are necessary on the two short sides.

Terminals other than the heater driving connection terminal 801 and ground connection terminal 802 are used as a heater driving enable terminal, data input terminal, latch terminal, clock terminal, logic power supply terminal, temperature sensor terminal, rank measurement terminal, and the like.

These days, inkjet printing apparatuses are demanded for higher printing resolutions and higher printing speeds. The element substrate for an inkjet printhead needs to be elongated to cope with a higher-density arrangement of heaters and logic circuits, a larger number of orifice arrays corresponding to a larger number of ink colors, and a larger number of heaters. As a result, the area of the element substrate increases, raising the cost.

FIG. 5 is a plan view of an example of the element substrate of an inkjet printhead. As represented by an orifice portion 501 in FIG. 5, a plurality of types of orifices having different orifice diameters and the like are arranged so that ink of the same color can be discharged by different discharge amounts. Known examples of the printhead having this arrangement are ones disclosed in U.S. Pat. No. 6,137,502 and Japanese Patent Laid-Open No. 2007-144711 (WO2007/061138).

Referring to FIG. 6 which is an enlarged view of the orifice portion 501, orifices 602 of array A have a discharge amount of 2 pl and an array density of 600 dpi. Orifices 601 of array B have a discharge amount of 2 pl and an array density of 600 dpi. Orifices 603 of array C have a discharge amount of 1 pl and an array density of 600 dpi. Arrays B and C are positioned on the same side of an ink supply port 604, and orifices are staggered. The orifices of arrays B and C are arrayed at an array density of 1,200 dpi, which is substantially double that of array A. In other words, orifices are formed at an array density of 600 dpi on one side of the ink supply port 604, and those are formed at an array density of 1,200 display on the other side.

FIG. 10 is a view schematically showing the element substrate of the orifice portion 501 in FIG. 5. As shown in FIG. 10, heaters 104 corresponding to the orifices 602 of array A are arranged on one side of the ink supply port 604, whereas heaters 103 corresponding to the orifices 601 of array B and heaters 105 corresponding to the orifices 603 of array C are arranged on the other side. A driver 101 corresponds to each heater 103, a driver 102 corresponds to each heater 104, and a driver 107 corresponds to each heater 105. Reference numeral 106 denotes each logic circuit. In the array of the drivers 102, the drivers are arrayed at an array density of 600 dpi. In the array of the drivers 101 and 107, the drivers are arrayed at an array density of 1,200 dpi.

Problems will be described, which arise when a plurality of orifice arrays having the same discharge amount exist on a single element substrate, and the drivers of respective driver arrays are formed at different array densities in the respective driver arrays corresponding to the respective orifice arrays. The following description assumes that the driver is a transistor.

FIG. 11 shows the arrangement of the heater driving power supply wiring patterns 803 and ground wiring patterns 804 which are superposed on the circuit shown in FIG. 10 via an insulating film.

The heaters 103 and 104 discharge ink droplets in the same discharge amount of 2 pl. To make discharge characteristics such as the discharge amount and discharge speed equal to each other, driving conditions are desirably made equal. That is, the heaters 103 and 104 are desirably driven with the same pulse using the same heat enable signal which defines the period during which the heater is driven.

The number of heat enable signal terminals is desirably small in order to downsize the element substrate. A small number of heat enable signals is advantageous even in cost because the printing apparatus main body need not have many pulse tables.

To make discharge characteristics such as the discharge amount and discharge speed equal to each other, and share the heat enable signal, it is desirable to make the size equal between heaters and make the ON resistance and wiring resistance equal between drivers. In FIG. 10, the drivers 101 and 102 have the same width in the driver array direction and the same length L1 in a direction perpendicular the driver array direction, and have the same size. Thus, the drivers 101 and 102 have the same ON resistance, and the heater driving power supply wiring pattern 803 and ground wiring pattern 804 in FIG. 11 have the same sizes and wiring resistances for both the heaters 103 and 104. In this case, the heaters 103 and 104 can be driven by the same heat enable signal, and attain the same discharge characteristics.

However, as is apparent from the drivers 102 in FIG. 10, they are arranged in accordance with a 1,200-dpi heater array though they are originally arrayed at 600 dpi. A gap is generated between adjacent drivers, resulting in poor arrangement efficiency, that is, an unnecessarily large chip size.

FIGS. 12 and 13 are schematic views, similar to FIGS. 10 and 11, and show an example of improving the driver arrangement efficiency.

The drivers 102 are arrayed at 600 dpi, similar to FIG. 10. In order to make the ON resistance of the drivers 102 equal to that of the drivers 101 arrayed at 1,200 dpi, the length of the driver 102 in a direction perpendicular to the heater array direction is halved while the area of the driver 102 is kept constant, preventing generation of an unnecessary space.

In this case, as shown in FIG. 13, each driver needs to be connected on the outer side to the ground wiring pattern 804. The wiring width of the heater driving power supply wiring pattern 803 is narrowed in accordance with the driver 102. Although the area above the drivers 101 and 107 is sufficiently large, the wiring width is narrowed to set the wiring resistance of the driver 101 equal to that of the driver 102 and make discharge characteristics equal to each other.

In this case, the driver arrangement efficiency can be increased to downsize the element substrate, but the wiring resistance rises, decreasing the electrical efficiency.

As described above, when a plurality of orifice arrays having the same discharge amount exist on a single element substrate, and transistors which form respective driver arrays are formed at different array densities, it is difficult to achieve both a small-size element substrate and high electrical efficiency.

SUMMARY OF THE INVENTION

The present invention can provide an element substrate capable of achieving both a small-size element substrate and high electrical efficiency when a plurality of orifice arrays having the same discharge amount exist on a single element substrate, and transistors which form respective driver arrays are formed at different array densities.

An element substrate according to the present invention comprises a first printing element array and a second printing element array each formed of a plurality of printing elements for discharging a liquid by substantially the same liquid discharge amount; a third printing element array formed of printing elements which discharge the liquid by a discharge amount different from the discharge amount of the printing elements of the first and second printing element arrays and are staggered from the printing elements of the second printing element array; a first driver array formed of a plurality of driving elements arranged near the first printing element array, a second driver array formed of a plurality of driving elements arranged near the second printing element array, and a third driver array formed of a plurality of driving elements arranged near the third printing element array, the second driver array and the third driver array forming a single array; a first power supply wiring pattern arranged at a position where the first power supply wiring pattern overlaps an area where the first driver array is arranged, and in a different layer; and a second power supply wiring pattern arranged in the layer and at a position where the second power supply wiring pattern overlaps an area where the second driver array and the third driver array are arranged, wherein an array density of the driving elements of the first driver array is lower than an array density of the driving elements of the single array formed from the second driver array and the third driver array, an area of each of the driving elements of the first driver array is larger than an area of each of the driving elements of the second driver array and is larger than an area of each of the driving elements of the third driver array, and a wiring width of the first power supply wiring pattern in a direction perpendicular to the printing element arrays is smaller than a wiring width of the second power supply wiring pattern.

The present invention provides a printhead and head cartridge having the element substrate.

According to the present invention, the area of drivers arrayed at low density is set larger than that of drivers arrayed at high density. The ON resistance of the drivers arrayed at low density becomes lower than that of the drivers arrayed at high density. To make driving conditions equal between the array of orifices corresponding to the drivers arrayed at low density and that of orifices corresponding to the drivers arrayed at high density, the wiring resistance of the drivers arrayed at low density is set higher than that of the drivers arrayed at high density. That is, the heater driving power supply wiring pattern of the drivers arrayed at low density can be narrowed. The element substrate can be efficiently downsized without decreasing the electrical efficiency.

Further features of the present invention will become apparent from the following description of exemplary embodiments with reference to the attached drawings.

DESCRIPTION OF THE EMBODIMENTS

Figure 1:
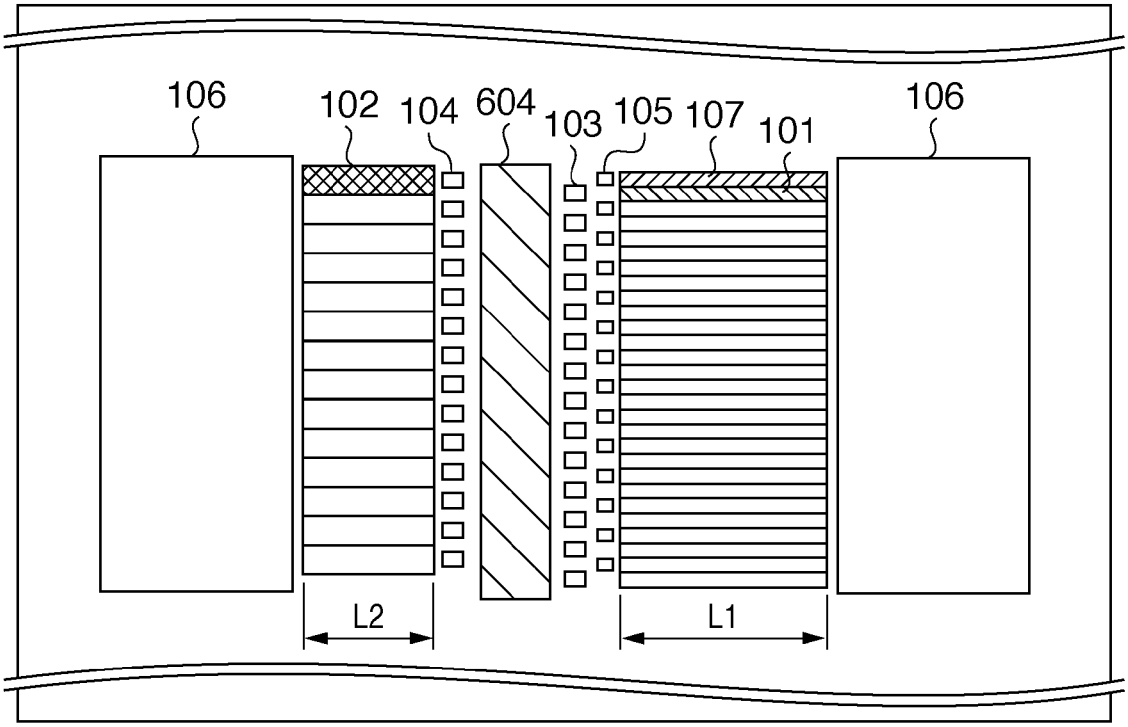
FIG. 1 is a view showing the heater, driver, and logic circuit of an element substrate according to the present invention.

Preferred embodiments of the present invention will be described in detail below with reference to the accompanying drawings. The same reference numerals denote the same parts, and a description thereof will not be repeated.

In this specification, the term "printing" (to be also referred to as "print" hereinafter) not only includes the formation of significant information such as characters and graphics, but also broadly includes the formation of images, figures, patterns, and the like on a print medium, or the processing of the medium, regardless of whether they are significant or insignificant and whether they are so visualized as to be visually perceptible by humans.

Also, the term "print medium" not only includes paper used in general printing apparatuses, but also broadly includes materials capable of accepting ink, such as cloth, a plastic film, a metal plate, glass, ceramics, wood, and leather.

The term "ink" should be extensively interpreted similar to the definition of "print" described above. "Ink" includes a liquid which, when applied onto a print medium, can form images, figures, patterns, and the like, can process the print medium, and can process ink. Ink processing includes solidification or insolubilization of a coloring agent in ink applied to the print medium.

The term "element substrate" in the description means not a simple substrate made of a silicon semiconductor, but a substrate having elements, wiring patterns, and the like.

The expression "on an element substrate" includes not only "on the surface of an element substrate", but also "inside of an element substrate near its surface". The term "built-in" in the present invention means not "simply arrange separate elements on a substrate", but "integrally form and manufacture elements on an element substrate by a semiconductor circuit manufacturing process or the like".

The schematic structure of an inkjet printing apparatus will be explained.

Figure 8:
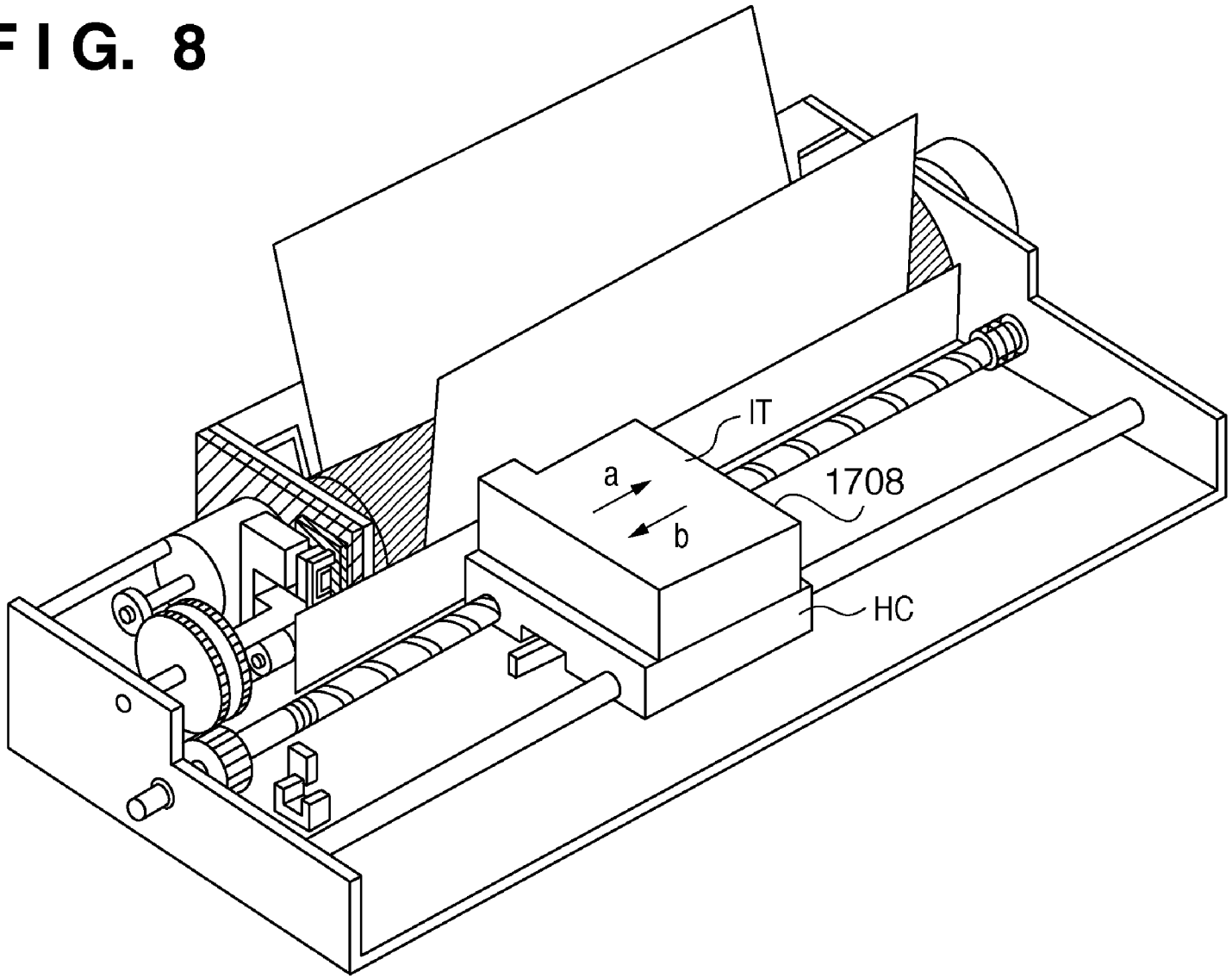
FIG. 8 is a schematic view of an inkjet printing apparatus.

FIG. 8 is a perspective view of the schematic outer appearance of an inkjet printing apparatus to which the present invention is applicable. In FIG. 8, a carriage HC supports an integral head cartridge incorporating a printhead 1708 and an ink tank IT (liquid container) which contains ink. The carriage HC reciprocates in directions indicated by arrows a and b. During reciprocation, the printhead discharges ink to print.

Figure 9:
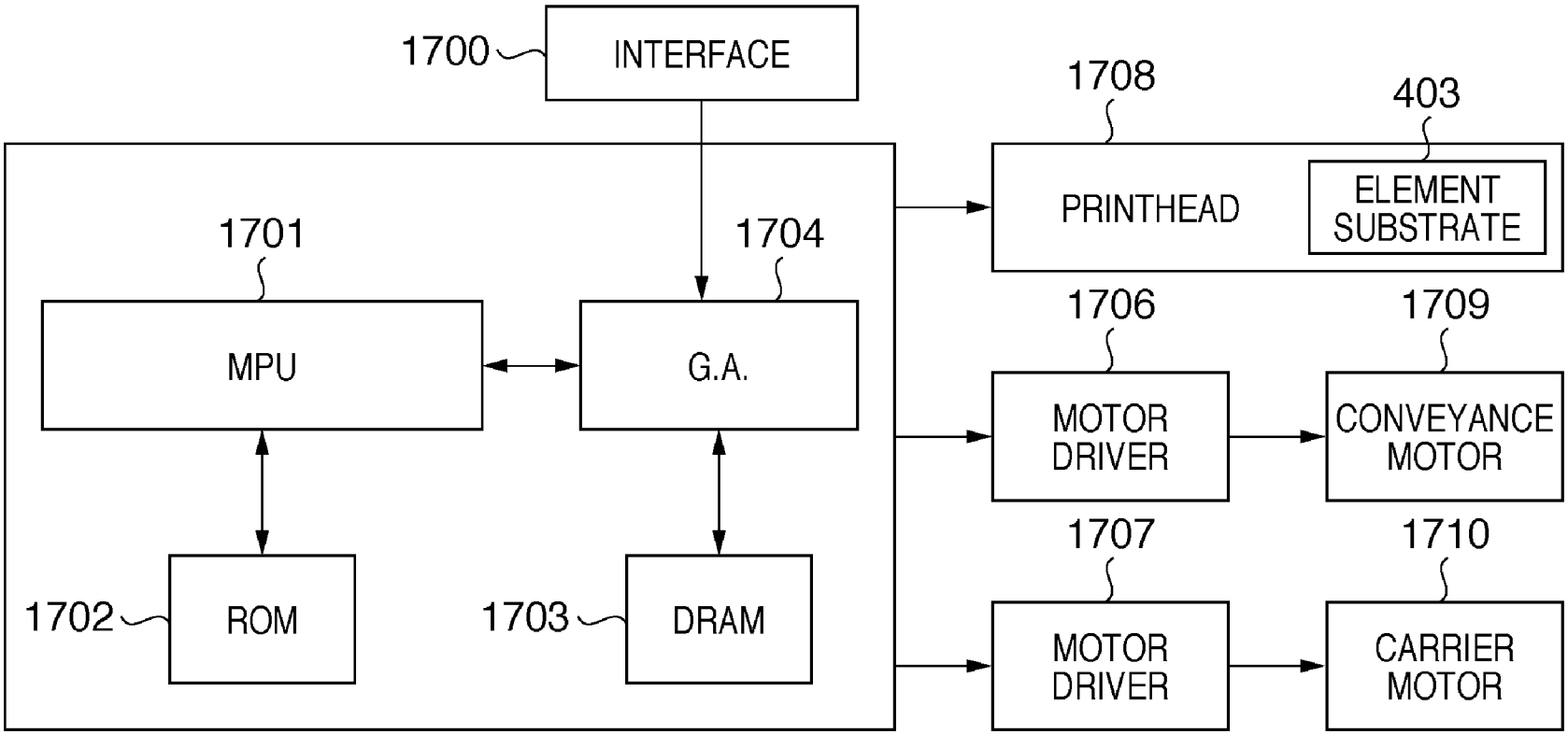
FIG. 9 is a block diagram showing the control arrangement of the inkjet printing apparatus.

A control arrangement for executing printing control of the inkjet printing apparatus will be explained with reference to the block diagram of FIG. 9. In FIG. 9 showing a control circuit, an interface 1700 receives a print signal from a host computer or the like. Reference numeral 1701 denotes an MPU. A ROM 1702 stores control programs to be executed by the MPU 1701. A DRAM 1703 saves various data (e.g., the print signal, and print data supplied to a printhead 1708). A gate array (G.A.) 1704 controls supply of print data to the printhead 1708, and also controls data transfer between the interface 1700, the MPU 1701, and the DRAM 1703. A carrier motor 1710 conveys the printhead. A conveyance motor 1709 conveys a print medium. A motor driver 1706 drives the conveyance motor 1709. A motor driver 1707 drives the carrier motor 1710. Reference numeral 1708 denotes the printhead; and 403, an element substrate for the printhead.

The operation of the control arrangement will be described. When a print signal is input to the interface 1700, it is converted into print data between the gate array 1704 and the MPU 1701. Then, the motor drivers 1706 and 1707 are driven, and the printhead 1708 and the element substrate 403 are driven in accordance with print data, executing printing.

The printhead will be described.

Figure 4:
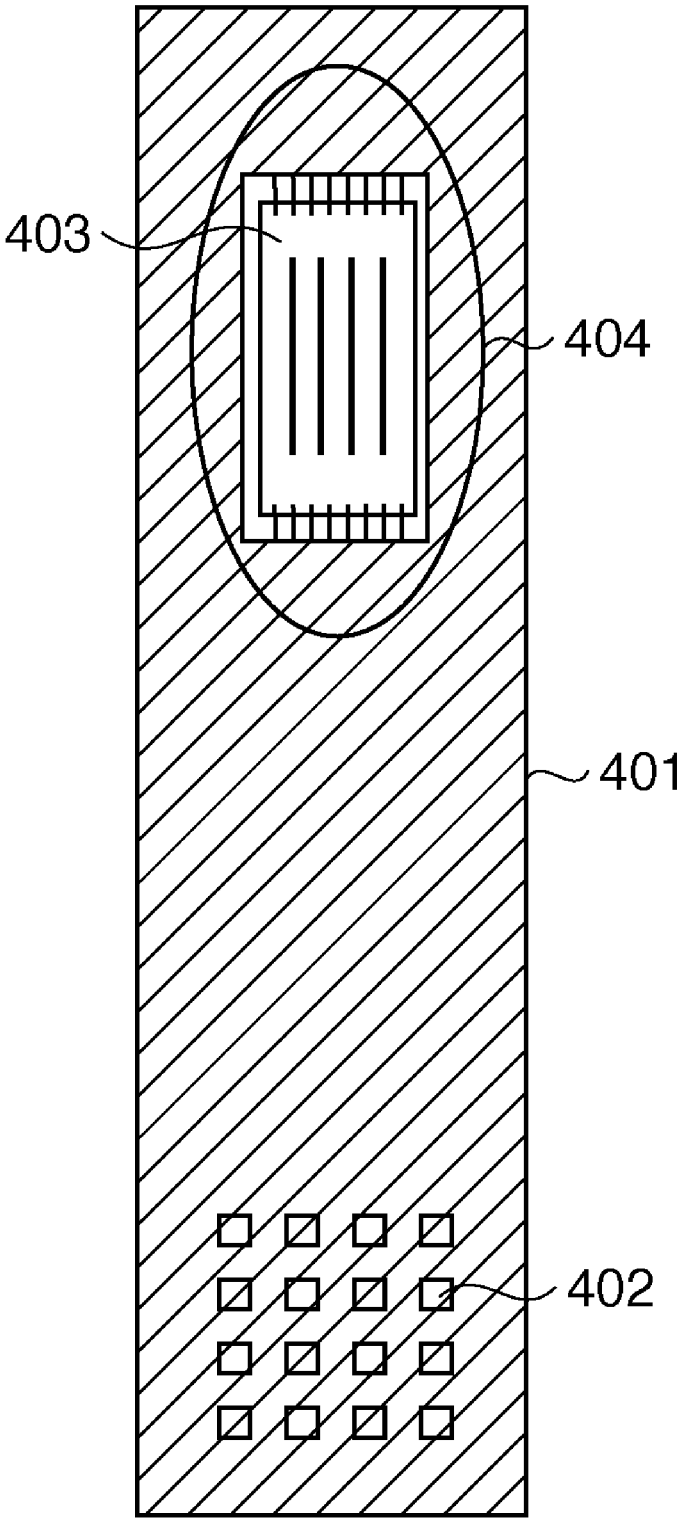
FIG. 4 is a view showing a state in which the element substrate according to the present invention is mounted on a TAB tape.

FIG. 4 is a view showing a state in which the element substrate 403 having a plurality of heaters is mounted on a TAB tape 401. Contact terminals 402 are arranged on one end of the TAB tape 401 to connect the TAB tape 401 to the inkjet printing apparatus main body. The element substrate 403 is connected on the other end via inner leads.

Figure 5:
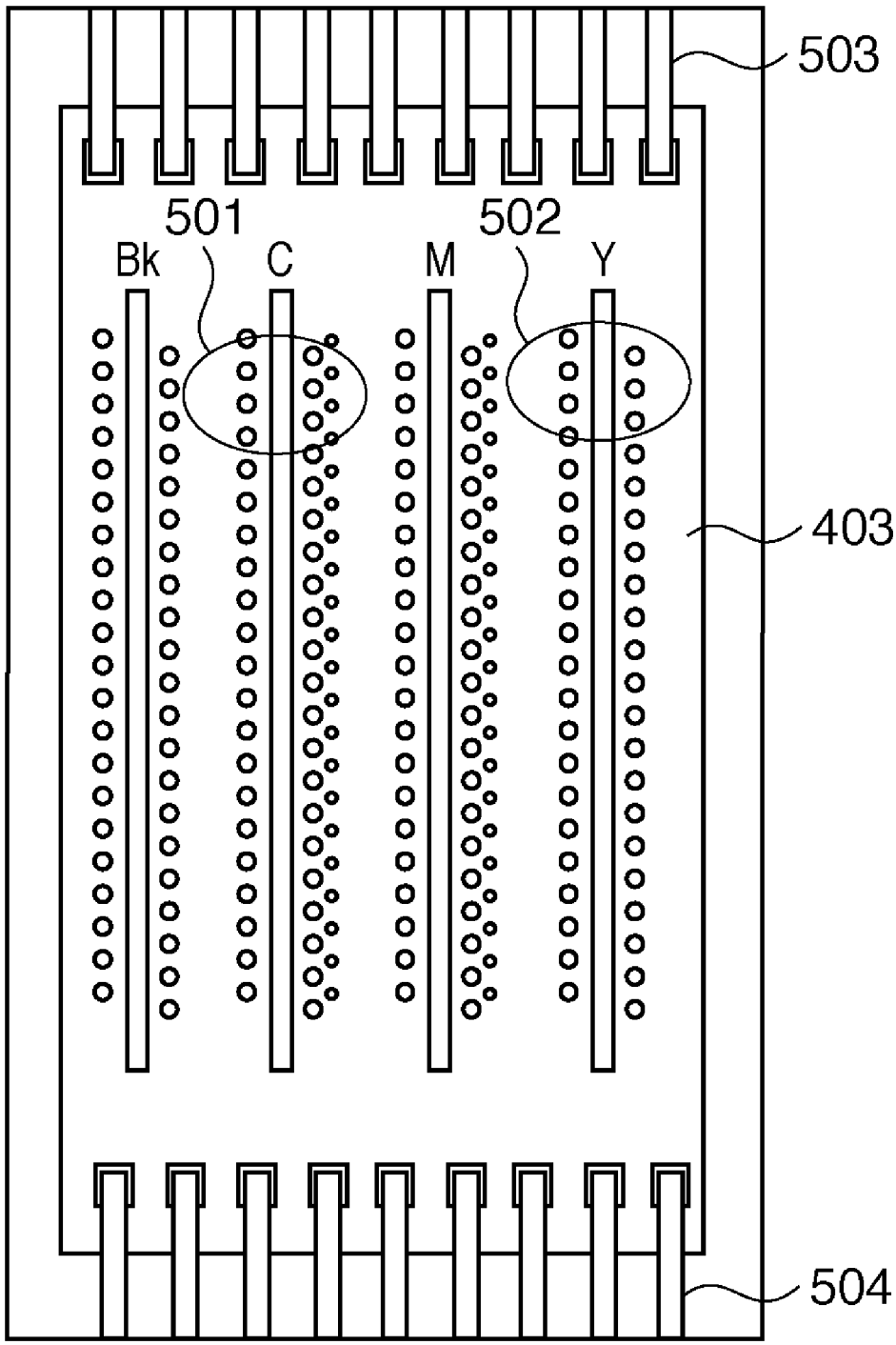
FIG. 5 is an enlarged view of the element substrate.

FIG. 5 is an enlarged view of a portion 404 in FIG. 4. Inner leads 503 and 504 project from the device holes of the TAB tape 401. The inner leads 503 and 504 are electrically connected to connection terminals by gang bonding.

Figure 7:
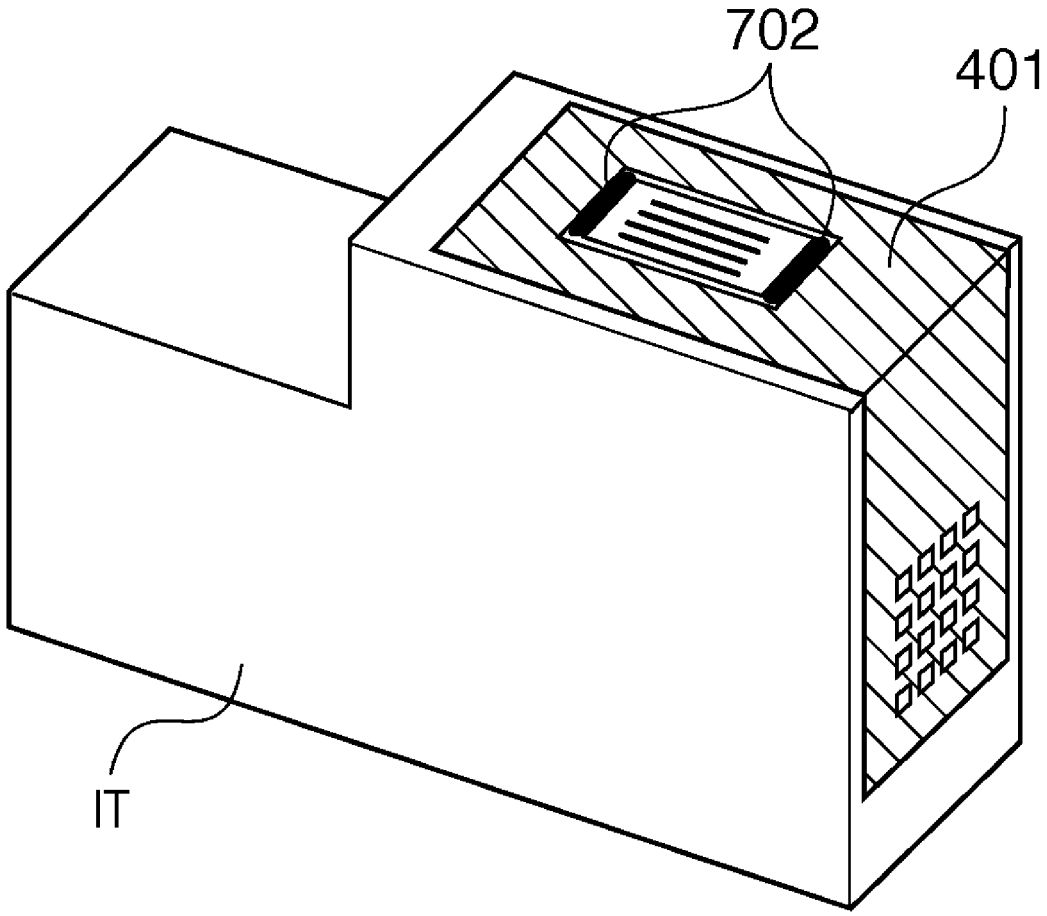
FIG. 7 is a view showing an entire printhead.

FIG. 7 shows the completed form of the printhead. The TAB tape 401 in FIG. 4 is joined to the ink tank IT. The inner leads projecting from the device holes are sealed with a sealing material 702. The TAB tape 401 is bent to fix the contact terminals 402 tightly to the wall surface of the ink tank IT. The element substrate serves as the upper side in FIG. 7, but as the lower side when mounted in the inkjet printing apparatus.

First Embodiment

An element substrate and printhead according to the first embodiment will be described with reference to FIGS. 1 to 3.

FIG. 1 is a schematic view showing heaters 103, 104, and 105, drivers 101, 102, and 107, and logic circuits 106 of the element substrate according to the first embodiment.

An ink supply port 604 is formed at the center of the element substrate. The array of the heaters 104 and the array of the drivers 102 are arranged close to each other on one side of the ink supply port 604, whereas the arrays of the heaters 103 and 105 and the arrays of the drivers 101 and 107 are arranged close to each other on the other side. Each driver is a transistor serving as a kind of driving element. In each heater array, 512 heaters are arrayed at an array density (pitch) of 600 dpi. The heaters 103 and 105 are staggered. In the array of the drivers 102 corresponding to the heaters 104, 512 drivers are arrayed at a pitch of 600 dpi. In the array of the drivers 101 corresponding to the heaters 103 and the drivers 107 corresponding to the heaters 105, 1,024 drivers are arrayed at a pitch of 1,200 dpi.

The heaters 103 and 104 have the same area and shape in order to discharge ink by the same ink discharge amount (liquid discharge amount).

Figure 6:
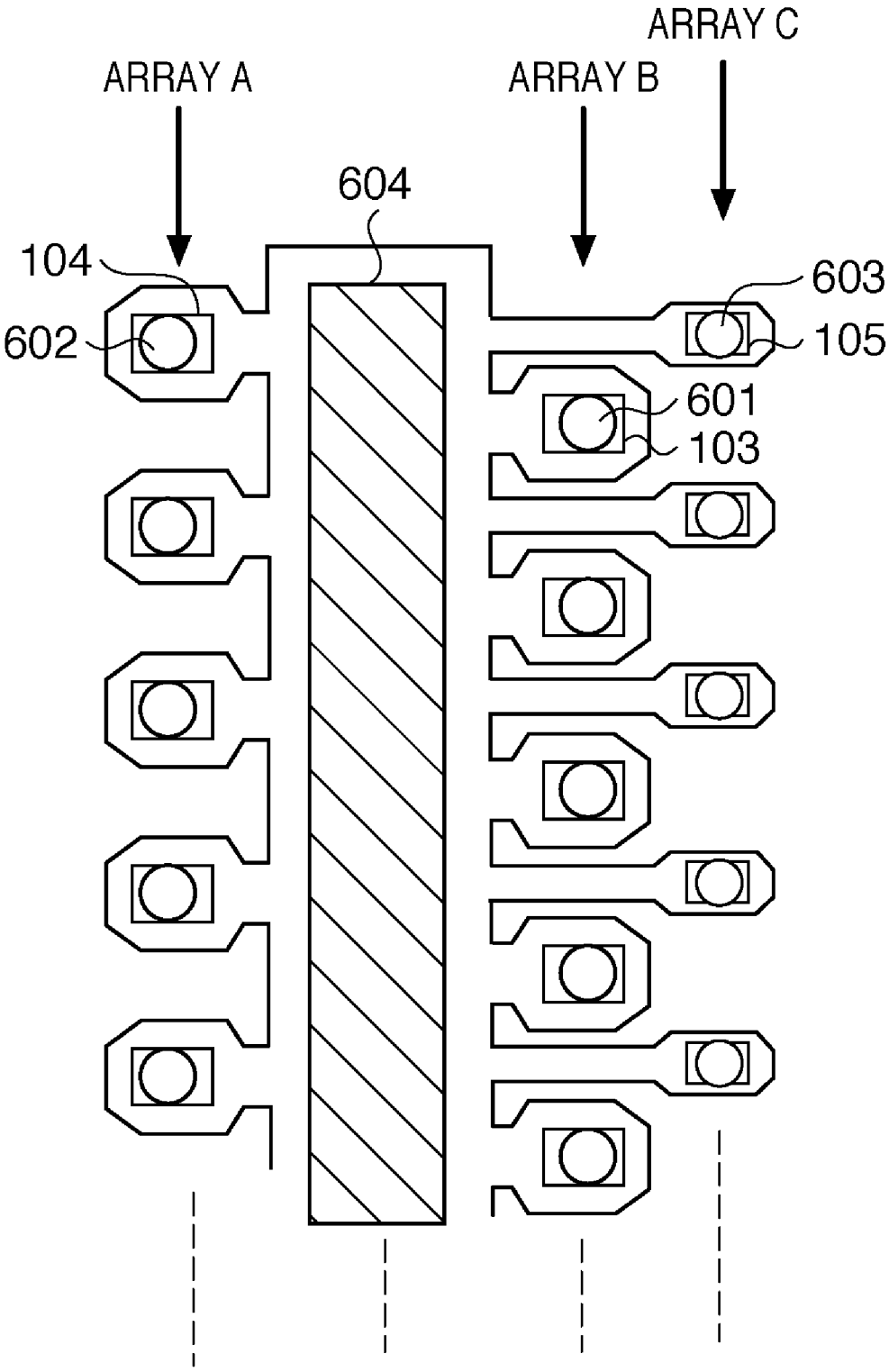
FIG. 6 is an enlarged view of an orifice portion.

FIG. 6 shows orifices (printing elements) corresponding to the respective heater arrays shown in FIG. 1. The heater 103 corresponds to an orifice 601, and the heater 104 corresponds to an orifice 602. The discharge amount from each orifice is 2 pl. The heater 105 corresponds to an orifice 603, and the discharge amount is 1 pl. The array of the orifices 602 serves as the first orifice array (first printing element array), that of the orifices 601 serves as the second orifice array (second printing element array), and that of the orifices 603 serves as the third orifice array (third printing element array). The array of the drivers 102 serves as the first driver array, and that of the drivers 101 and 107 serves as the second driver array.

Figure 2:
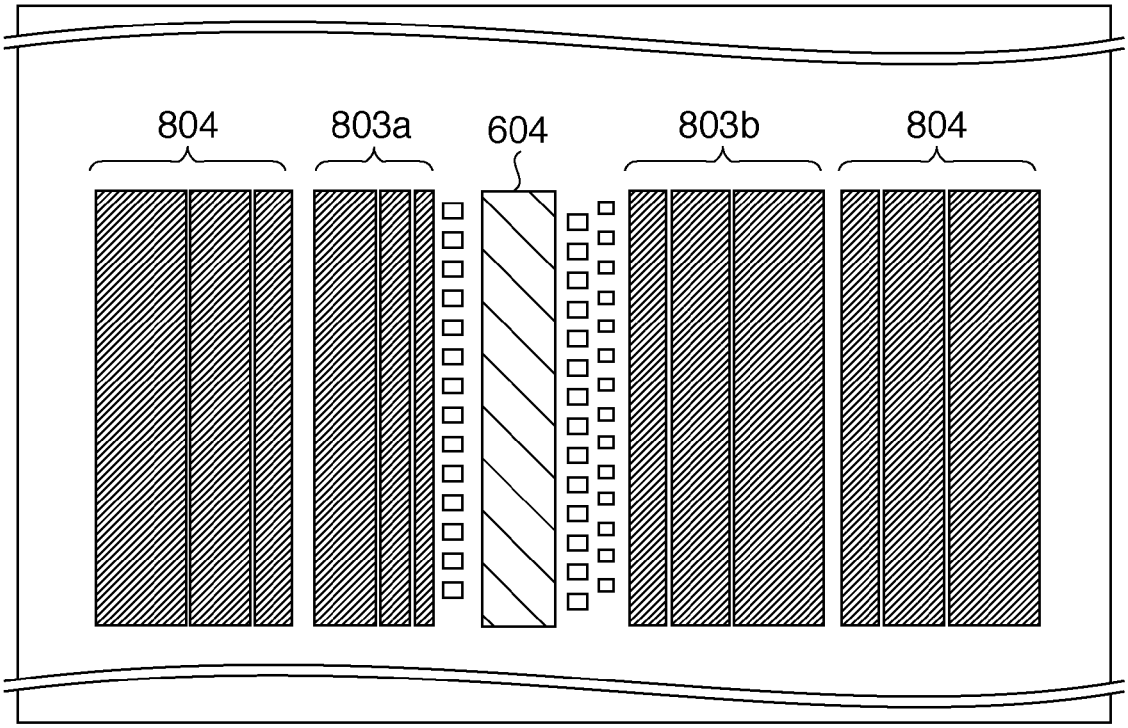
FIG. 2 is a view showing the power supply wiring pattern and the like of the element substrate according to the present invention.

FIG. 2 is a schematic view showing the power supply wiring patterns and the like of the element substrate according to the first embodiment.

Figure 3:
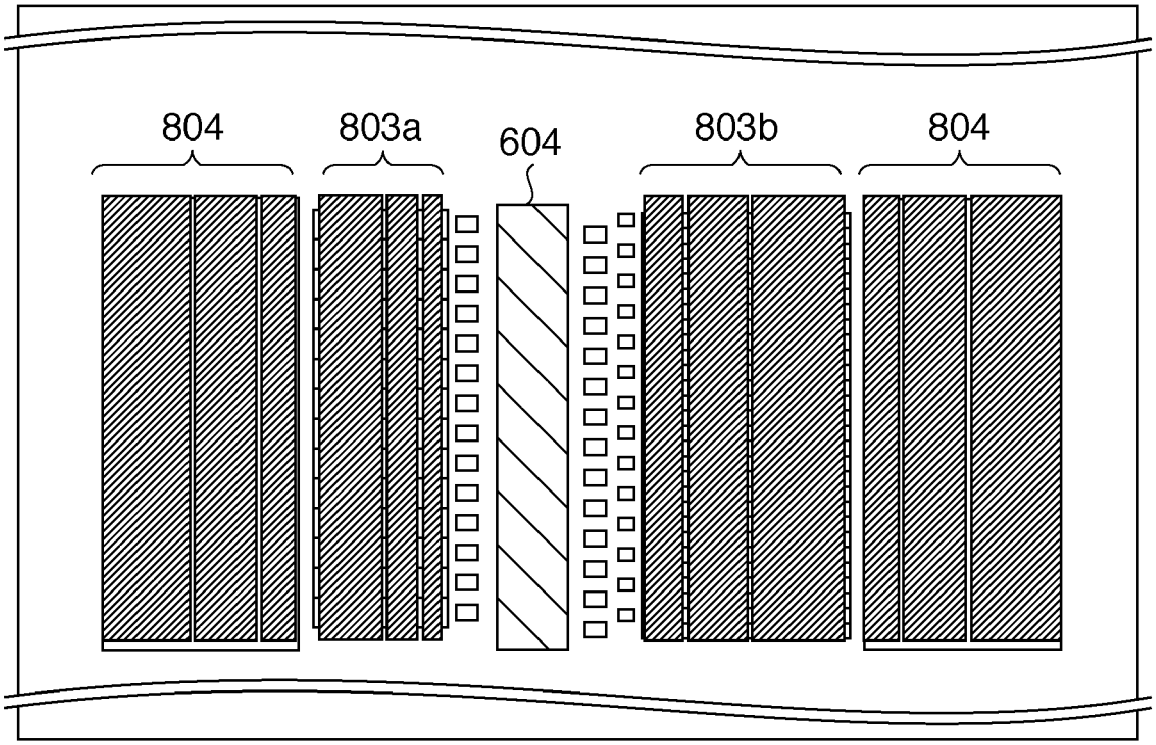
FIG. 3 is a schematic view obtained by superposing FIGS. 1 and 2.

FIG. 3 is a schematic view obtained by superposing the power supply wiring patterns in FIG. 2 on the drivers and logic circuits in FIG. 1. Heater driving power supply wiring patterns 803*a* and 803*b* are arranged on the array of the drivers 102 and that of the drivers 101 and 107, respectively. Ground wiring patterns 804 are arranged on the logic circuits 106. The element substrate according to the present invention has this multilayered structure. The heater driving power supply wiring pattern 803*a* serves as the first power supply wiring pattern, and the heater driving power supply wiring pattern 803*b* serves as the second power supply wiring pattern. The first power supply wiring pattern is arranged at a position where it overlaps an area where the first driver array is arranged, and in a different layer. The second power supply wiring pattern is arranged in this layer and at a position where it overlaps an area where the second and third driver arrays are arranged.

In FIG. 1, the drivers 101 and 102 drive heaters having the same discharge amount of 2 pl, so their areas should be originally made equal to have the same ON resistance. In the first embodiment, however, letting S1 be the area of the driver 101 and S2 be that of the driver 102, S2>S1. That is, the area of the driver 102 is set larger than that of the driver 101. The array density of the first driver array is lower than that of the array of the drivers 101 and 107. In the first embodiment, the drivers 101 and 107 are arrayed at 1,200 dpi, and the drivers 102 are arrayed at 600 dpi. Thus, sizes L1 and L2 of the drivers 101 and 102 in a direction perpendicular to the heater array direction satisfy L2>L1/2.

As a result, an ON resistance R102 of the driver 102 becomes lower than an ON resistance R101 of the driver 101. To make driving conditions equal to each other, the wiring resistance of the driver 102 needs to be set higher than that of the driver 101. In FIG. 2, the heater driving power supply wiring pattern 803*a* above the driver 102 is narrower (in a direction perpendicular to the printing element array) than the heater driving power supply wiring pattern 803*b* above the drivers 101 and 107. Wiring resistances R803*a* and R803*b* corresponding to the respective heater driving power supply wiring patterns satisfy a relation:

$$R102+R803a=R101+R803b$$

Concrete numerical values in the first embodiment are L1=200 μm, L2=120 μm, R101=40Ω, R102=33.3Ω, and R803*b*=10Ω. Since the ON resistances of the drivers 102 and 101 are different by 6.7Ω, R803*a*=16.7Ω is set to satisfy the above relation.

Assuming that L1 is almost equal to the wiring width of the heater driving power supply wiring pattern 803*b*, the entire wiring width of the heater driving power supply wiring pattern 803*b* is set to 200 μm. The wiring width of the heater driving power supply wiring pattern 803*a* is calculated from these values, obtaining 200 μm×16.7Ω/10Ω=120 μm, which is almost equal to the width L2. The area above the drivers can be efficiently used as a wiring area.

This arrangement of the element substrate makes it possible to drive the heaters 103 and 104 having the same discharge amount under the same driving conditions.

Figure 10:
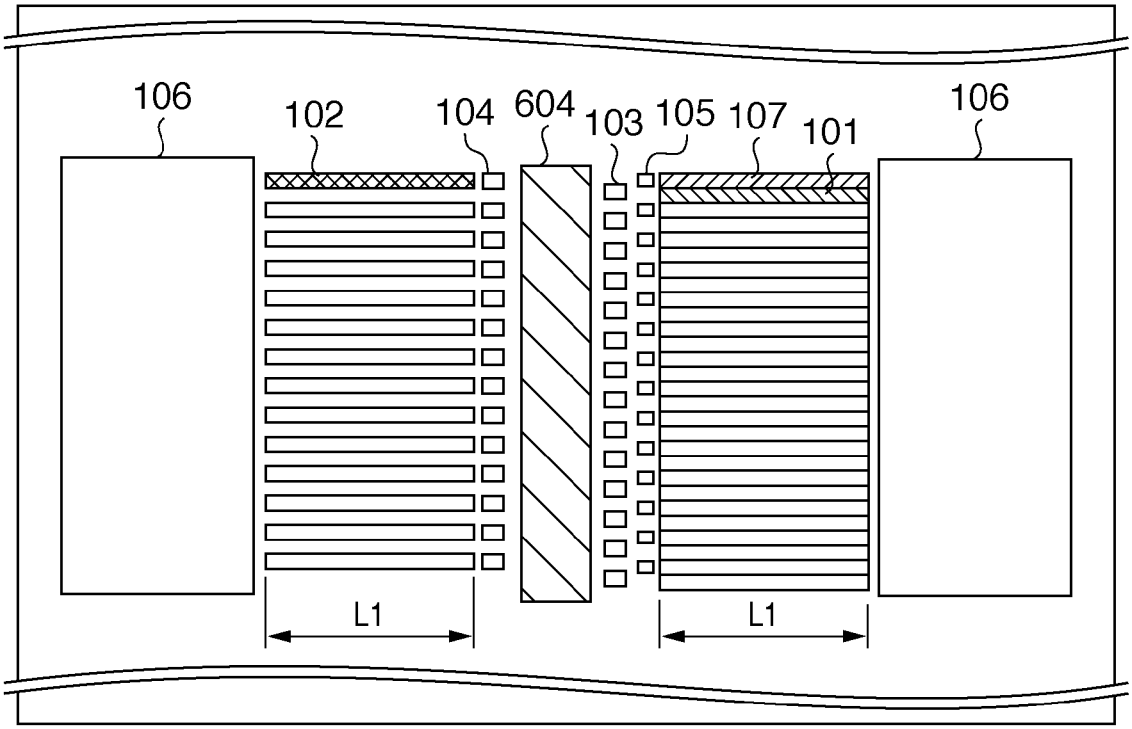
FIG. 10 is a view showing the heater, driver, and logic circuit of a conventional element substrate.
Figure 11:
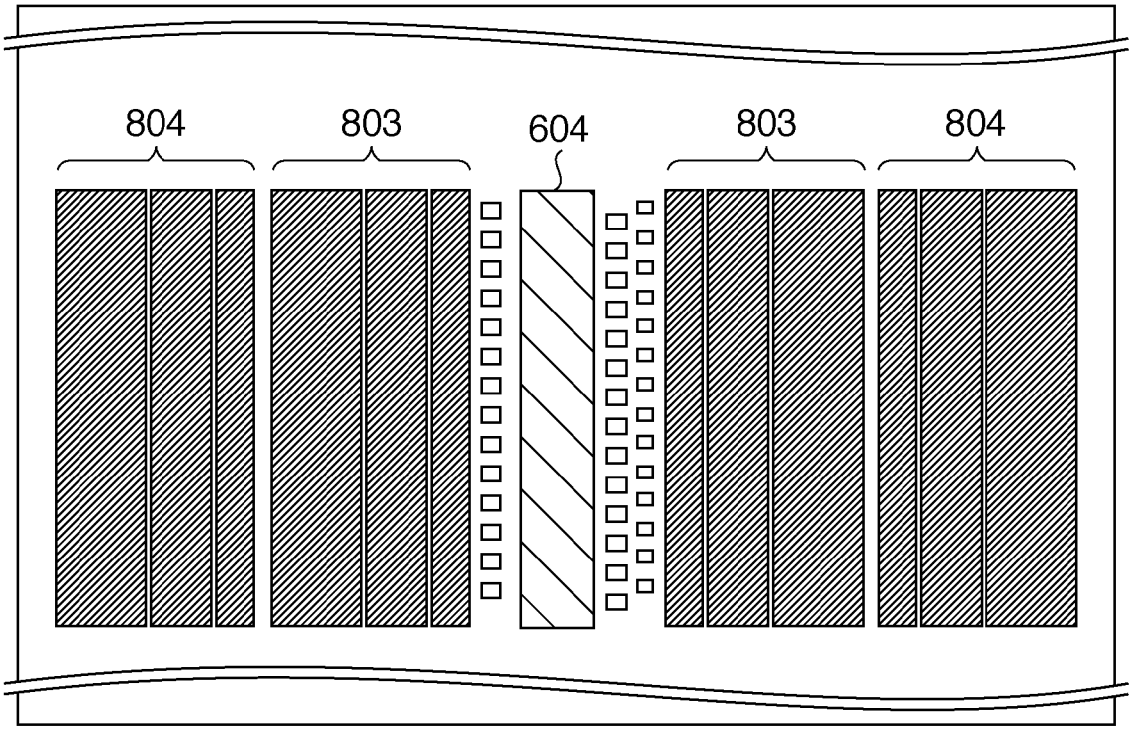
FIG. 11 is a view showing the power supply wiring pattern and the like of the conventional element substrate.

Compared to a prior art shown in FIG. 10, the drivers 102 arrayed at 600 dpi can be downsized.

Figure 12:
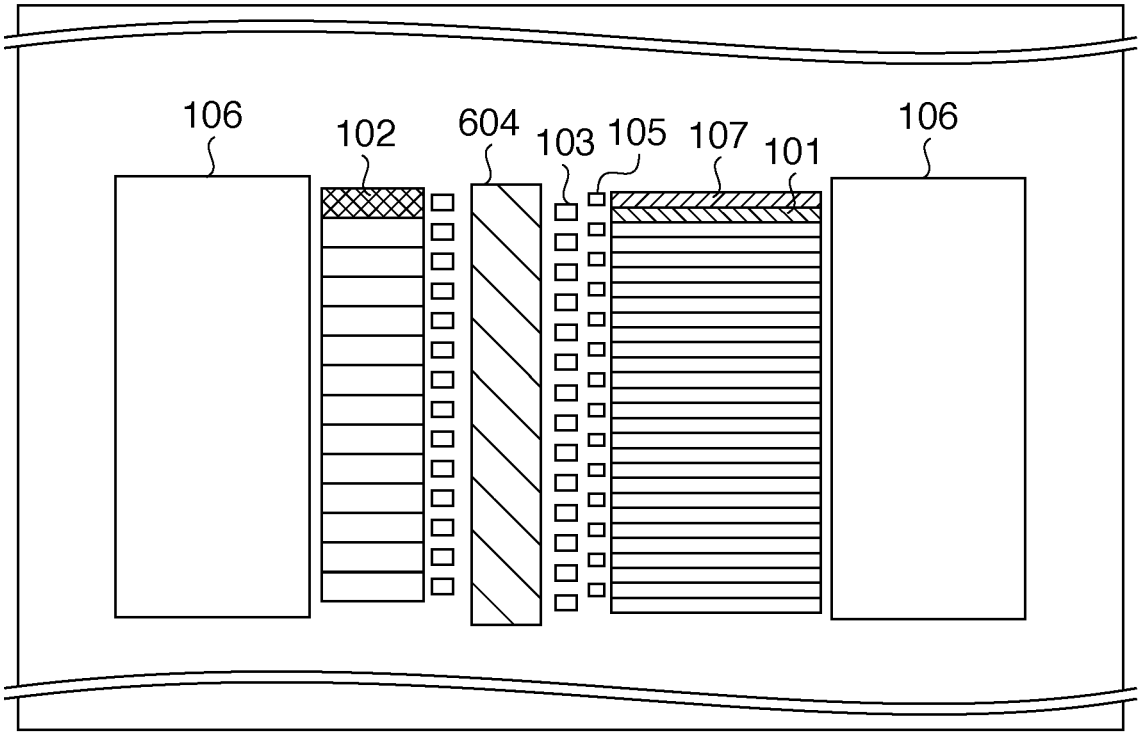
FIG. 12 is a view showing the heater, driver, and logic circuit of a conventional element substrate.
Figure 13:
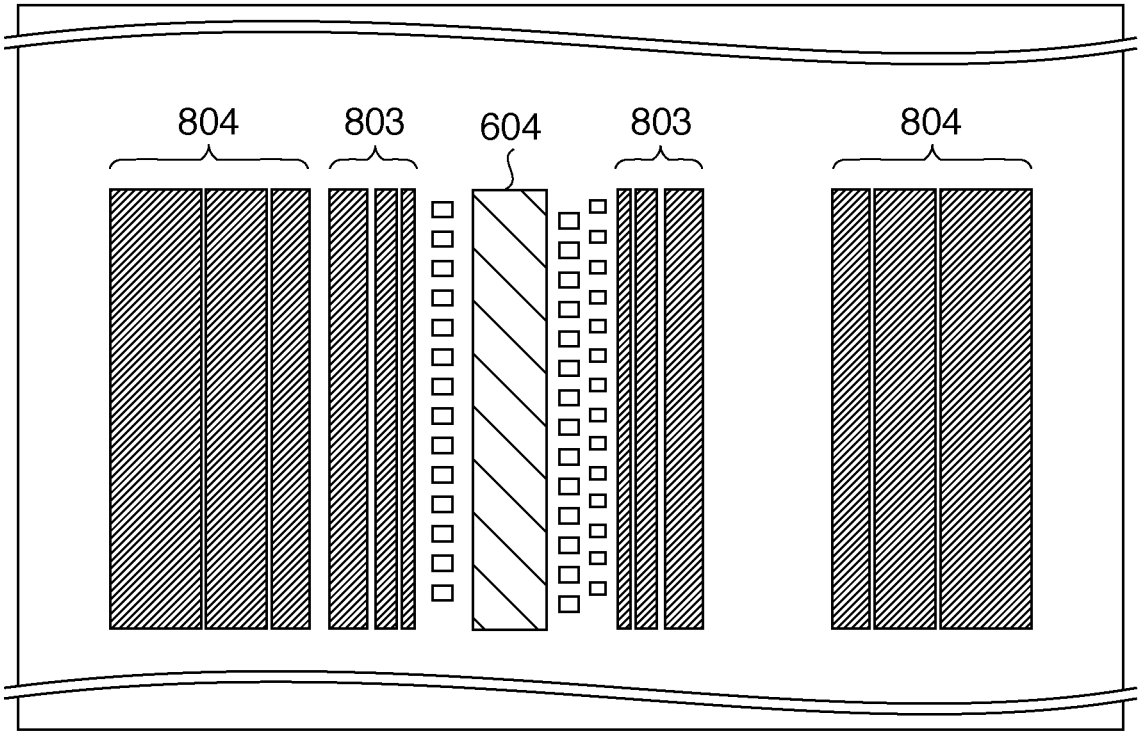
FIG. 13 is a view showing the power supply wiring pattern and the like of the conventional element substrate.

Compared to a prior art shown in FIGS. 12 and 13, the size of a conventional driver 102 is smaller. However, the sum of the wiring resistance and ON resistance can be suppressed smaller than the conventional one, achieving high electrical efficiency.

Second Embodiment

An element substrate and printhead according to the second embodiment will be described with reference to FIGS. 14 to 17.

Figure 14:
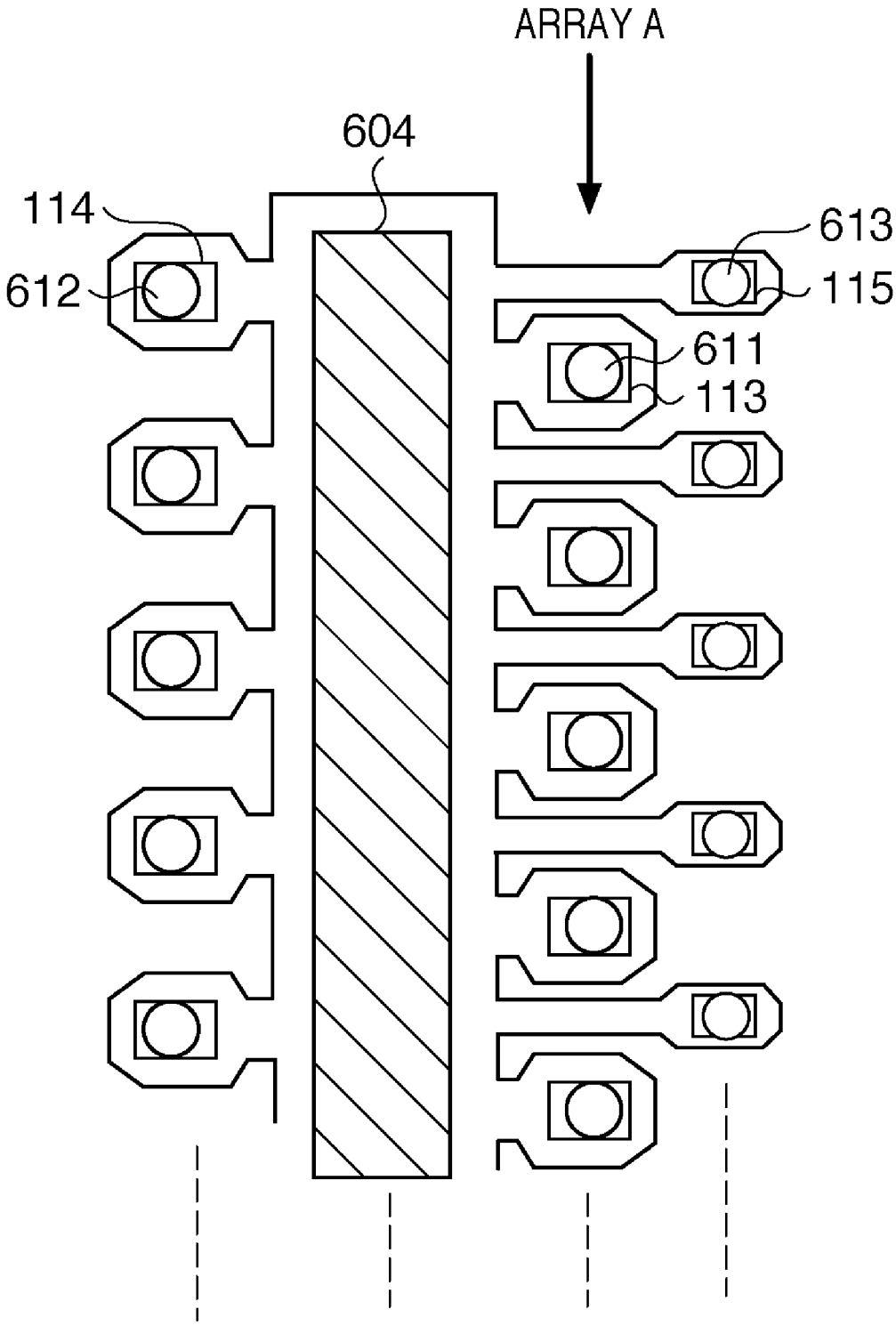
FIG. 14 is an enlarged view of an orifice portion.
Figure 15:
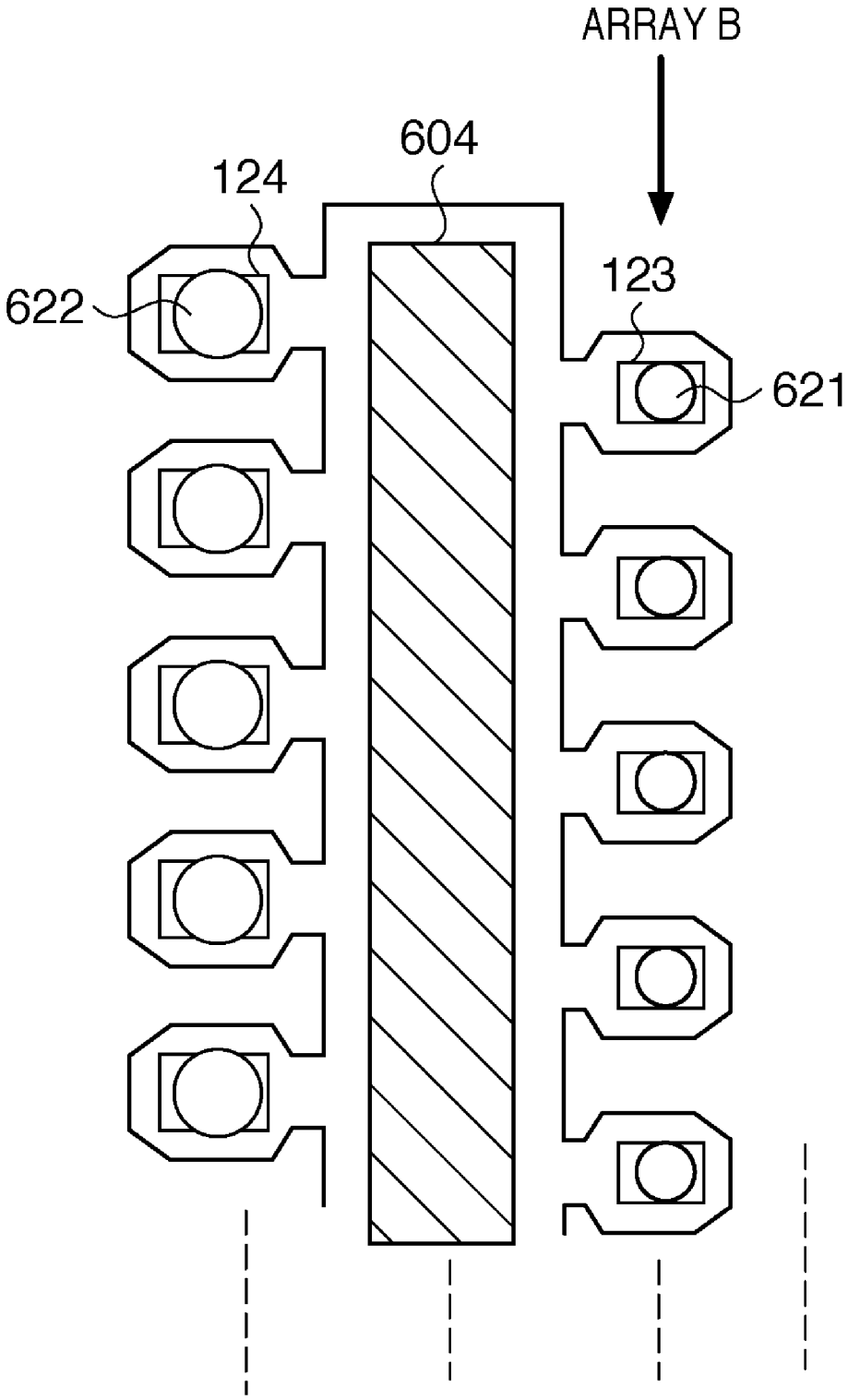
FIG. 15 is an enlarged view of an orifice portion.

FIG. 14 is an enlarged view of an orifice portion 501 in FIG. 5, that is, orifice arrays for discharging cyan ink. FIG. 15 is an enlarged view of an orifice portion 502 in FIG. 5, that is, orifice arrays for discharging yellow ink.

The ink droplet discharge amount from each orifice in the second embodiment is different from that in the first embodiment. In FIG. 14, an orifice 612 discharges a 5-pl ink droplet, an orifice 611 discharges a 2-pl ink droplet, and an orifice 613 discharges a 1-pl ink droplet. A heater 114 corresponds to the orifice 612, a heater 113 corresponds to the orifice 611, and a heater 115 corresponds to the orifice 613. In FIG. 15, an orifice 622 discharges a 5-pl ink droplet, and an orifice 621 discharges a 2-pl ink droplet. A heater 124 corresponds to the orifice 622, and a heater 123 corresponds to the orifice 621.

Array A shown in FIG. 14 and array B shown in FIG. 15 discharge inks by the same volume though the ink color is different. It is desirable to make driving conditions equal to each other, similar to the first embodiment.

Figure 16:
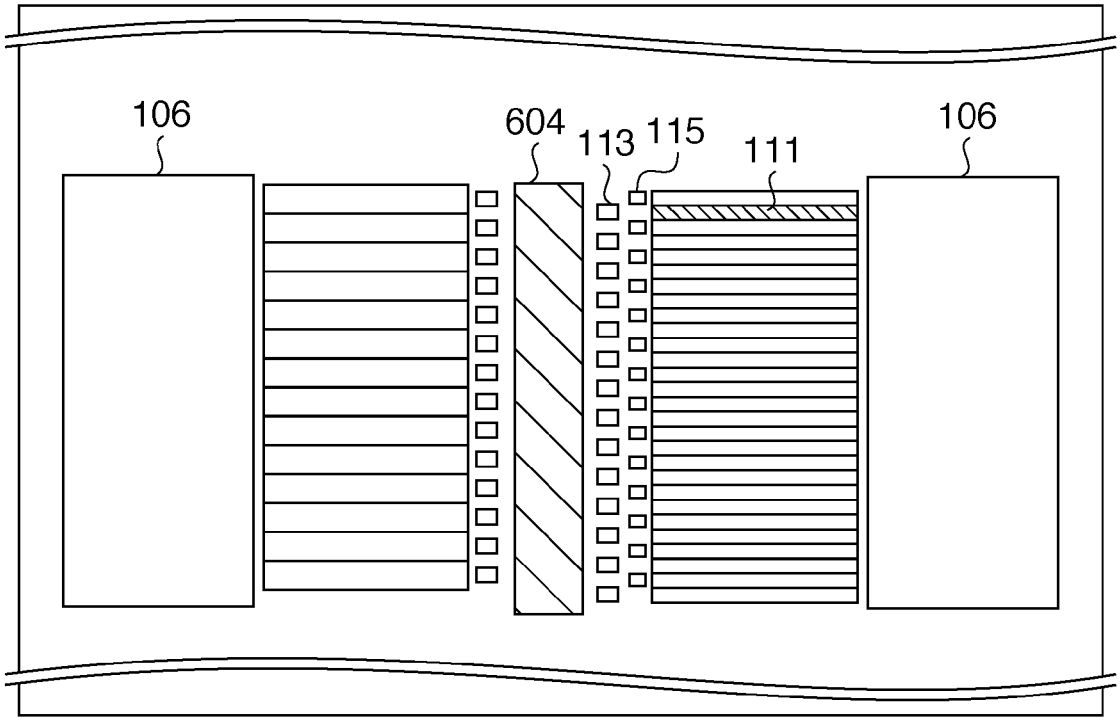
FIG. 16 is a view showing the heater, driver, and logic circuit of an element substrate according to the present invention.
Figure 17:
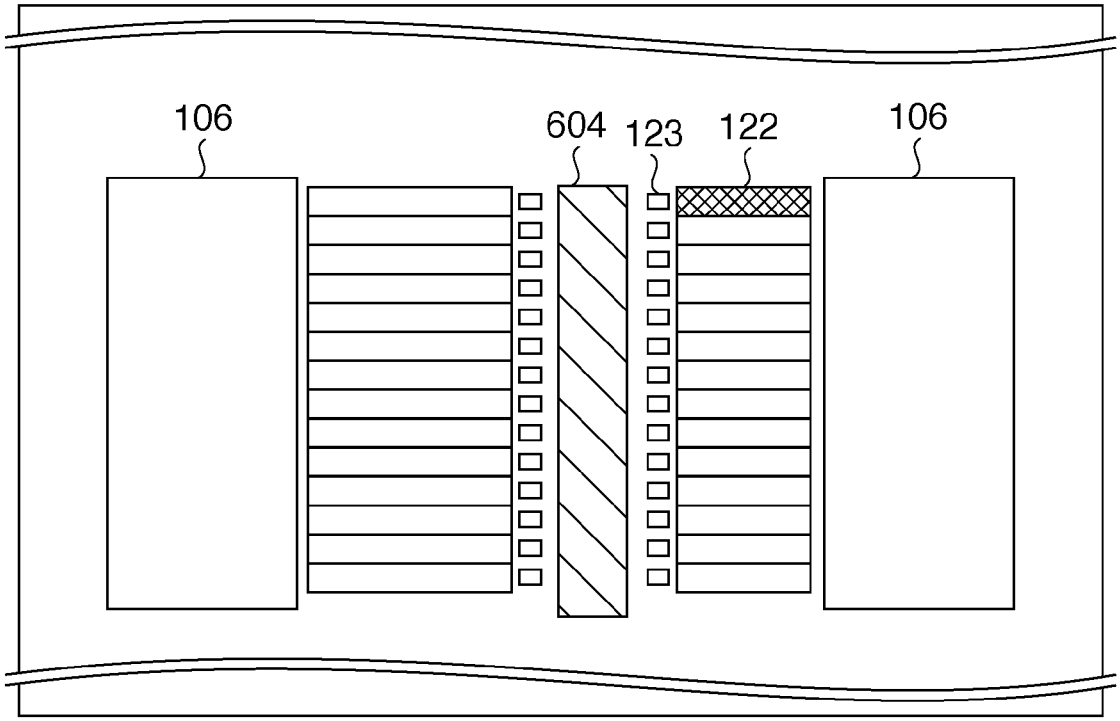
FIG. 17 is a view showing the heater, driver, and logic circuit of an element substrate according to the present invention.
Figure 18:
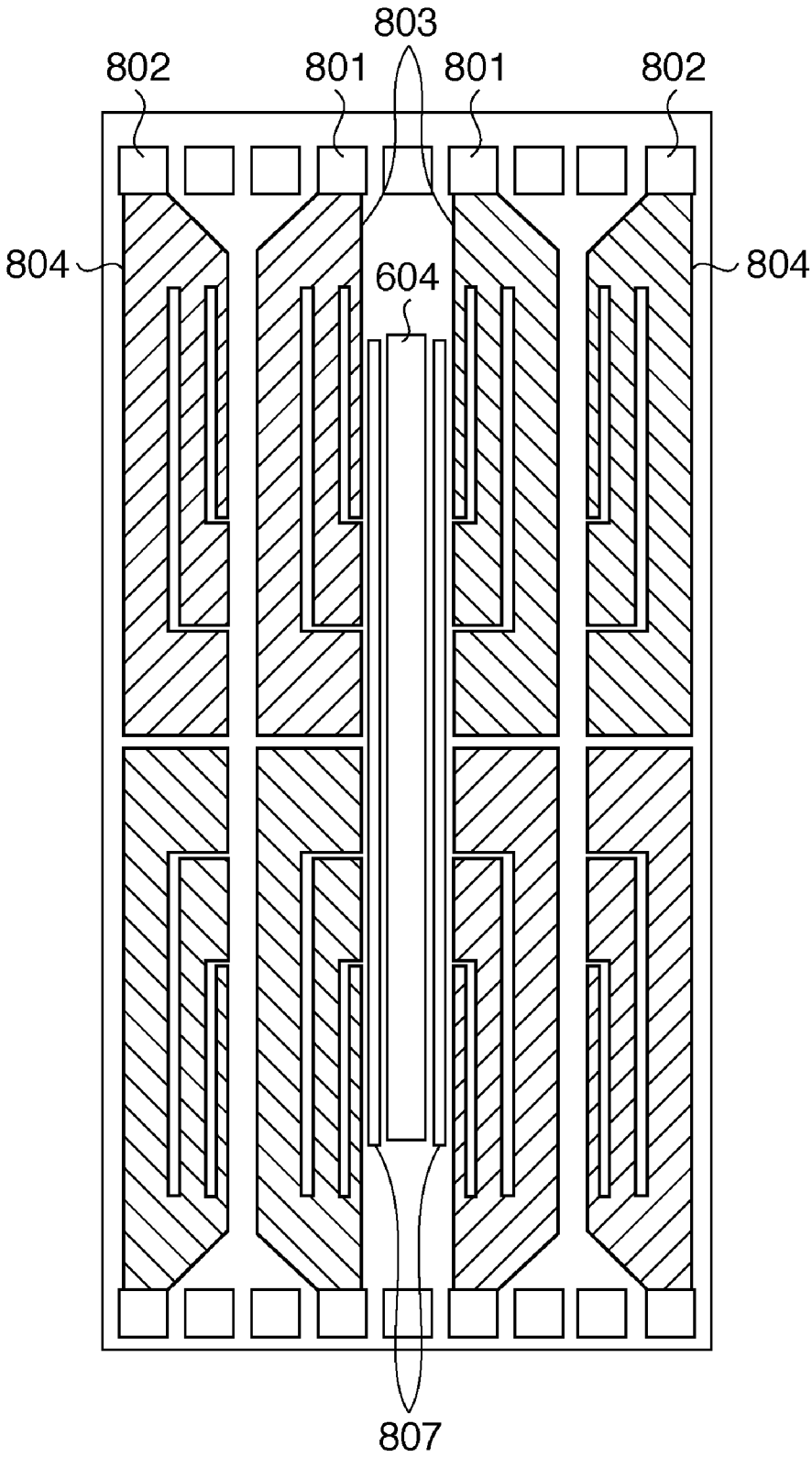
FIG. 18 is a view showing the power supply wiring pattern and the like of a conventional element substrate.
Figure 19:
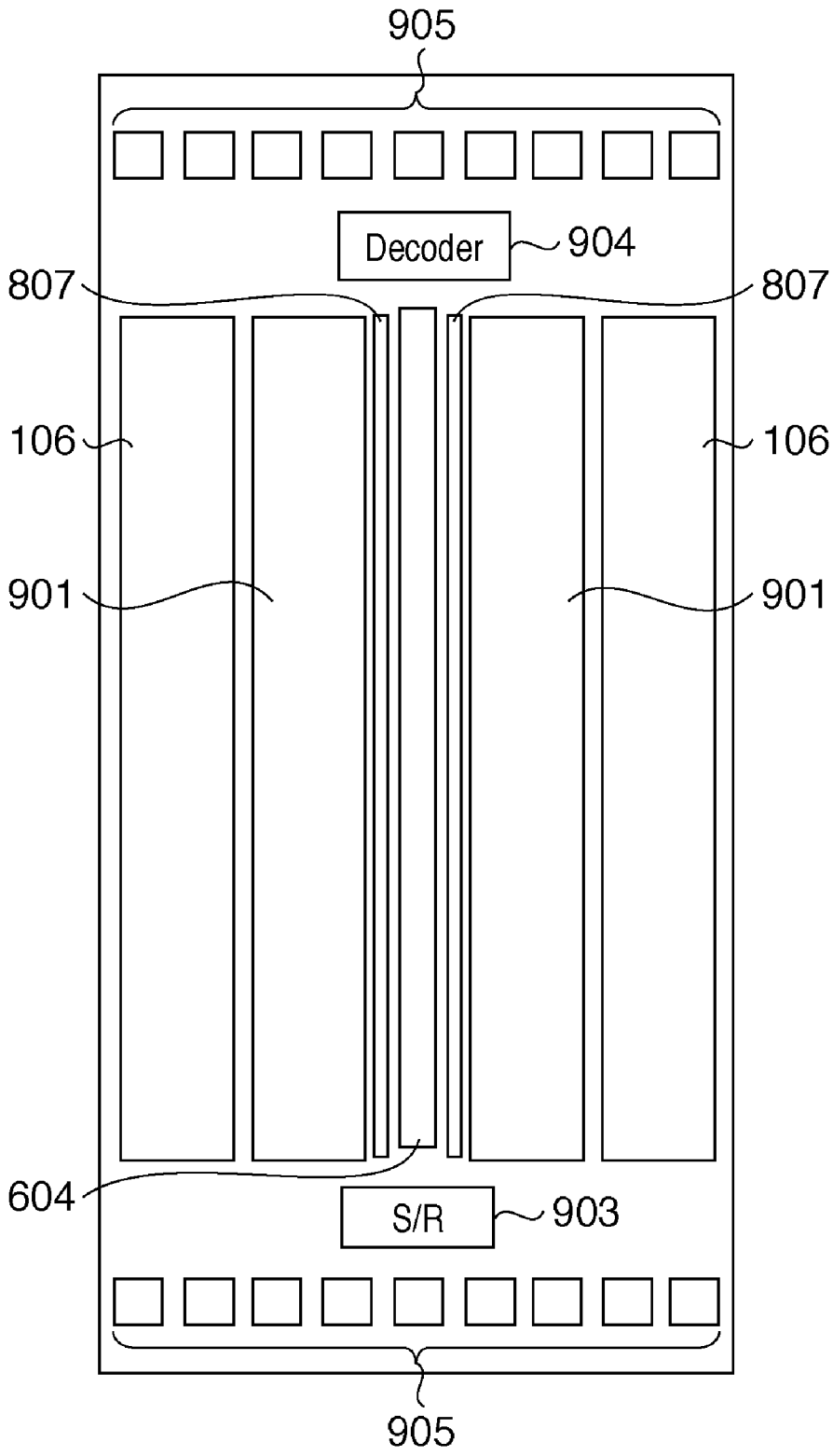
FIG. 19 is a view showing the heater, driver, and logic circuit of the conventional element substrate.

FIG. 16 is a view showing drivers and logic circuits corresponding to FIG. 14. FIG. 17 is a view showing drivers and logic circuits corresponding to FIG. 15.

The heaters 113 and 123 for discharging ink droplets of the same 2-pl discharge amount are equal in size to the heaters 103 and 104 used in the first embodiment. A driver 111 corresponding to the heater 113 is equal in size to the driver 101 corresponding to the heater 103 used in the first embodiment. A driver 122 corresponding to the heater 123 is equal in size to the driver 102 corresponding to the heater 104 used in the first embodiment. Although not shown, the power supply wiring pattern of each heater in the second embodiment is also equal in size to that of a corresponding heater in the first embodiment. This arrangement allows driving the heaters 113 and 123 having the same discharge amount under the same driving conditions.

The array of the orifices 621 serves as the first orifice array, that of the orifices 611 serves as the second orifice array, and that of the orifice 613 serves as the third orifice array. The array of the driver 122 serves as the first driver array, and that of the drivers 111 and drivers corresponding to the heaters 115 serves as the second driver array.

Similar to the first embodiment, the second embodiment can also increase the electrical efficiency by suppressing the sum of the wiring resistance and ON resistance small while downsizing the driver. In the first and the second embodiment, the first power supply wiring pattern and the second power supply wiring pattern may be arranged in the same layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-276756, filed Oct. 24, 2007, which is hereby incorporated by reference herein in its entirety.

What is claimed is:

1. An element substrate comprising:

a first printing element array and a second printing element array each formed of a plurality of printing elements for discharging a liquid by substantially the same liquid discharge amount;

a third printing element array formed of printing elements which discharge the liquid by a discharge amount different from the discharge amount of the printing elements of the first and second printing element arrays and are staggered from the printing elements of the second printing element array;

a first driver array formed of a plurality of driving elements arranged near the first printing element array, a second driver array formed of a plurality of driving elements arranged near the second printing element array, and a third driver array formed of a plurality of driving elements arranged near the third printing element array, the second driver array and the third driver array forming a single array;

a first power supply wiring pattern arranged at a position where the first power supply wiring pattern overlaps an area where the first driver array is arranged, and in a different layer; and a second power supply wiring pattern arranged in the layer and at a position where the second power supply wiring pattern overlaps an area where the second driver array and the third driver array are arranged, wherein an array density of the driving elements of the first driver array is lower than an array density of the driving elements of the single array formed from the second driver array and the third driver array, an area of each of the driving elements of the first driver array is larger than an area of each of the driving elements of the second driver array and is larger than an area of each of the driving elements of the third driver array, and a wiring width of the first power supply wiring pattern in a direction perpendicular to the printing element arrays is smaller than a wiring width of the second power supply wiring pattern.

2. The substrate according to claim 1, wherein an array density of the printing elements of the first printing element array is lower than an array density of the printing elements of the second printing element array and the third printing element array.

3. The substrate according to claim 1, wherein an ON resistance of the driving elements of the first driver array is lower than an ON resistance of the driving elements of the second driver array.

4. The substrate according to claim 1, wherein a sum of an ON resistance of the driving elements of the first driver array and a wiring resistance of the first power supply wiring pattern, and a sum of an ON resistance of the driving elements of the second driver array and a wiring resistance of the second power supply wiring pattern are substantially equal to each other.

5. The substrate according to claim 1, wherein the plurality of printing elements of the first printing element array and the second printing element array comprise heaters having the same shape.

6. An inkjet printhead comprising an element substrate defined in claim 1 in which the plurality of printing elements of the first printing element array and the second printing element array comprise heaters for discharging ink.

7. A head cartridge comprising an element substrate defined in claim 1 and a liquid container which contains ink.

* * * * *